US010094098B2

(12) United States Patent
Shain

(10) Patent No.: US 10,094,098 B2
(45) Date of Patent: Oct. 9, 2018

(54) FLUSH-ALL

(71) Applicant: Nat R. Shain, Riverside, CA (US)

(72) Inventor: Nat R. Shain, Riverside, CA (US)

( * ) Notice: Subject to any disclaimer, the term of this patent is extended or adjusted under 35 U.S.C. 154(b) by 17 days.

(21) Appl. No.: 15/288,044

(22) Filed: Oct. 7, 2016

(65) Prior Publication Data

US 2017/0114529 A1 Apr. 27, 2017

Related U.S. Application Data

(60) Provisional application No. 62/245,118, filed on Oct. 22, 2015.

(51) Int. Cl.

| | |
|---|---|
| ***E03D 1/00*** | (2006.01) |
| ***E03D 3/12*** | (2006.01) |
| ***E03D 5/10*** | (2006.01) |
| ***E03D 3/10*** | (2006.01) |
| ***E03D 5/092*** | (2006.01) |

(52) U.S. Cl.

CPC ..... *E03D 3/12* (2013.01); *E03D 3/10* (2013.01); *E03D 5/092* (2013.01); *E03D 5/105* (2013.01)

(58) Field of Classification Search

CPC ..... E03D 5/10
USPC ..... 4/313
See application file for complete search history.

(56) References Cited

U.S. PATENT DOCUMENTS

| | | | | |
|---|---|---|---|---|
| 5,187,818 | A * | 2/1993 | Barrett, Sr. | E03D 5/105 4/304 |
| 6,457,187 | B1 * | 10/2002 | Andersson | E03D 3/10 4/354 |
| 6,877,170 | B1 * | 4/2005 | Quintana | E03D 1/00 137/312 |
| 7,225,478 | B2 * | 6/2007 | Lim | E03D 5/105 4/313 |
| 7,565,706 | B2 * | 7/2009 | Janssen | E03D 3/10 4/353 |
| 2010/0186157 | A1 * | 7/2010 | Roeser | E03D 1/306 4/354 |
| 2015/0033463 | A1 * | 2/2015 | Roeser | E03D 3/10 4/407 |
| 2017/0058500 | A1 * | 3/2017 | Garrels | E03D 9/038 |

* cited by examiner

*Primary Examiner* — Lori Baker
(74) *Attorney, Agent, or Firm* — Kirk A. Buhler; Buhler & Associates

(57) ABSTRACT

Improvements in a toilet flush system where the flush is not determined only by a simple gravitational flow of the water tank content. The Flush-All provides a quick flush, as soon as the flush handle is released the flushing stops. There is no sticking of the flushing flapper, leaky flapper, leaky O-rings, sticky plungers, wasted water flow by improperly adjusted water level height as water continuously flows over the overfill tubing, or defects in the incoming water automatic shut off system or the noise that accompany such continuous flow. The Flush-All provides a universal design that can be used on most toilet bowls systems, a simple retrofitting procedure using a universal mounting base that is retrofitted to most existing toilet bowl. The only part to be replaced is the toilet tank. It is a quick and easy procedure that requires no structural damage or repair to the bathroom.

19 Claims, 15 Drawing Sheets

FLUSH-ALL

CROSS REFERENCE TO RELATED APPLICATIONS

This application claims the benefit of Provisional Application Ser. No. 62/245,118 filed Oct. 22, 2015 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a toilet flush system. More particularly, this flushing system is a revolutionary designed to flush a toilet, with major advantages over existing systems. The water tank is sealed and connected directly to city water I identify as Direct Water Pressure Tank abbreviated as (DWPT) ALL-TANK. The DWPT uses three different types of forces, water pressure, gravity and pressurized air to flush the toilet.

Description of Related Art Including Information Disclosed Under 37 CFR 1.97 and 1.98.

One major reason people waste water is when a toilet is flushed. The volume of a flush is determined by the volume of the contents in the toilet bowl tank being flushed down the drain. When the contents within the toilet is not completely flushed, a person may make multiple flushes to completely clear the bowl. A number of patents and or publications have been made to address these issues. Exemplary examples of patents and or publication that try to address this/these problem(s) are identified and discussed below.

U.S. Pat. No. 7,565,706 issued on Jul. 28, 2009 to Terrance E. Janssen discloses a Pressure Assisted Flush Assembly and Installation Methods. The pressure assisted flush assembly for a toilet includes a compressed air assisted flush water tank that includes a plunger device. One or more plumbing lines are used to connect an incoming water line to the flush water tank and the flush water tank to a toilet bowl. While it is a pressure assisted flush, as the flushing system discloses it still utilizes a predetermined flush volume because of the design restriction. While this patent is for a pressurized flush, each flush is the same volume and does not allow a person to flush a smaller or variable amount of water. This flushing system cannot be easily retrofitted to an existing toilet bowl.

All conventional toilet bowl tanks and flushers utilize a predetermined amount of water which necessitates the need for the automatic refill and automatic shut off mechanism. The Flush-All does not use a predetermined amount of flush water and therefore it does not need the automatic refill or automatic shut off. This is an important concept because the majority of breakdowns and failures associated with conventional toilet bowls and flushers is associated with the system attempt to measure this exact predetermined amount of water at each and every flush. This necessitates filling this amount of water into some type of a receptacle or a container such as toilet bowl water tank, plunger device assembly or some type of a bladder etc. Then after those containers are filled with water a second mechanism must be triggered to stop this refill process at just the exact time. Those two mechanisms of refilling and then stopping this refill involves many mechanical and hydraulic interactions at each and every flush and is bound to fail sooner or later sometimes with devastating effects. Even-though some of those devices have a pressurized flush receptacle or container this pressure is not a direct city water pressure which is more reliable and has a stronger and linear (water pressure stays constant) throughout the flush than a pressurized container that loses most of its initial pressure after a few seconds of the flush content is released into the drain pipe.

What is needed is a flushing system that operates with toilets having the different shapes and designs of the existing toilet bowls so as to make it easy to retrofit to those bowls without replacing the whole toilet bowl system only the tank. Regardless of the shape or the size of those water tanks, the flush mechanism and the attachment mechanism to the toilet bowls is the same in all of them. The person flushing the toilet determines the length of time and how much water is flushed down the toilet. It is an instant on and off (on demand) by holding down the flush handle momentarily as needed. The Flush-Alican be retrofitted to most existing systems by use of All-Universal mounting base as described herein or it can be made as a complete separate toilet bowl fixture. Here are some of the advantages of this system. The Flush-All proposed in this document provides the solution.

BRIEF SUMMARY OF THE INVENTION

Conventional water tanks have two systems that are very much prone to fatigue, malfunctions, leaks and sometimes floods. The two systems are including, but not limited to:

A. The rubber flappers with floaters and or the many complicated contraptions or devices that contains, diaphragms, relief valves, cartridge assemblies, actuators, air inducers, vacuum breakers, sufficient water pressure, pressure regulators, water line diameter size, air leaks or explosions caused by design fault or material fatigue, users unfriendly shut off, plungers, pistons, O-rings, bladders, etc. . . . , all which must be submerged in water 24/7 and many components that must move to function.

B. The automatic water refill system for the water tank with the associated moving parts (floaters) that requires adjustments to shut it off at just the right moment (water level). Check valves style shut off valves are also prone to fatigue and failure because of the properties of the materials used in them.

Both items A & B above requires a precise adjustments and because they contain many moving parts such as floats, O-rings, pistons, rubber balls, plungers, air inducers, cartridges . . . etc. . . . , that require continuous maintenance and repairs. The Flush-All eliminates those two system problems.

It is an object of the Flush-All to save water because the flush amount is not predetermined by the size of the tank reservoir (i.e. 1.6 Gallon). The flusher holds down the handle for the length of time he or she wants the water to flow. More for larger bowl content less for a minor flush.

It is an object of the Flush-All for the Flush-All to be an on demand flushing with the user determines the amount of flush by holding down the flush handle. This device is powered by direct city water pressure combined with reservoir water and pressured trapped air. The sudden release of this water reservoir's content combined by the sudden impact of the city water pressure & trapped air pressure will cause most toilet bowls to clear its contents in the first few seconds of flushing which means most users will not need to hold down the handle any longer than the usual time used in conventional flushing. This is an important feature in contrast to having a predetermined amount of flush water necessitates the need for refilling which requires time, way to measure the refilled amount, and an automatic shut off system. All those requirements cause water waste and failures associated with automatic water shut off mechanisms in addition to the loud noise this process generates.

It is an object of the Flush-All to provide forceful flushing. The water pressure of the incoming water with the gravitational weight of the tank water combined with the trapped air pressure (air is trapped because water fills up from the bottom) determines the strength of the flush. The flush is not determined only by a simple gravitational flow of the water tank content.

It is an object of the Flush-All to provide a quick flush, as soon as the flush handle is released the flushing stops. No need to contend with noisy water flow that is determined by the time it will takes for the flapper falling down period and the refill contraption is shut off.

It is an object of the Flush-All to provide a major water saving device. There is no sticking of the flushing flapper, leaky flapper, warn out O-ring, sticky plungers, wasted water flow by improperly adjusted water level height as water continuously flows over the overfill tubing, or defects in the incoming water automatic shut off system or the noise that accompany such continuous flow.

It is an object of the Flush-All to not require the user to wait for the water tank to stops re-filling in case the flapper gets stuck in the open position as the rubber components wear out being in water 24/7, or as the flapper chain getting tangled-up.

It is another object of the Flush-All to prevent one the major causes of water damage to homes and businesses by the overflowing of a defective/damaged conventional toilet bowls water flushing systems.

It is another object of the Flush-All to provide a universal design that can be used on most toilet bowls systems, a simple retrofitting procedure using the exclusive ALL-UNIVERSAL MOUNTING BASE design (see description later) that would save the country a lot of water as we encounter more and more drought situations. To prevent mold growth (a major health hazard) that is caused by many leaks and humidity (unsealed water tanks filled with water) that would leak or increase the humidity.

It is still another object of the Flush-All to require only replacement of the tank and use the existing bowl. This system can virtually be retrofitted to any existing toilet bowl. The only part to be replaced is the toilet tank. It is a quick and easy procedure that requires no structural damage or repair to the bathroom.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Note: IN the following FIGS. 1-16 is for describing the Flush-All and its parts. This description used the term All in reference to the name of components assigned to the Flush-All.

Figure 1:
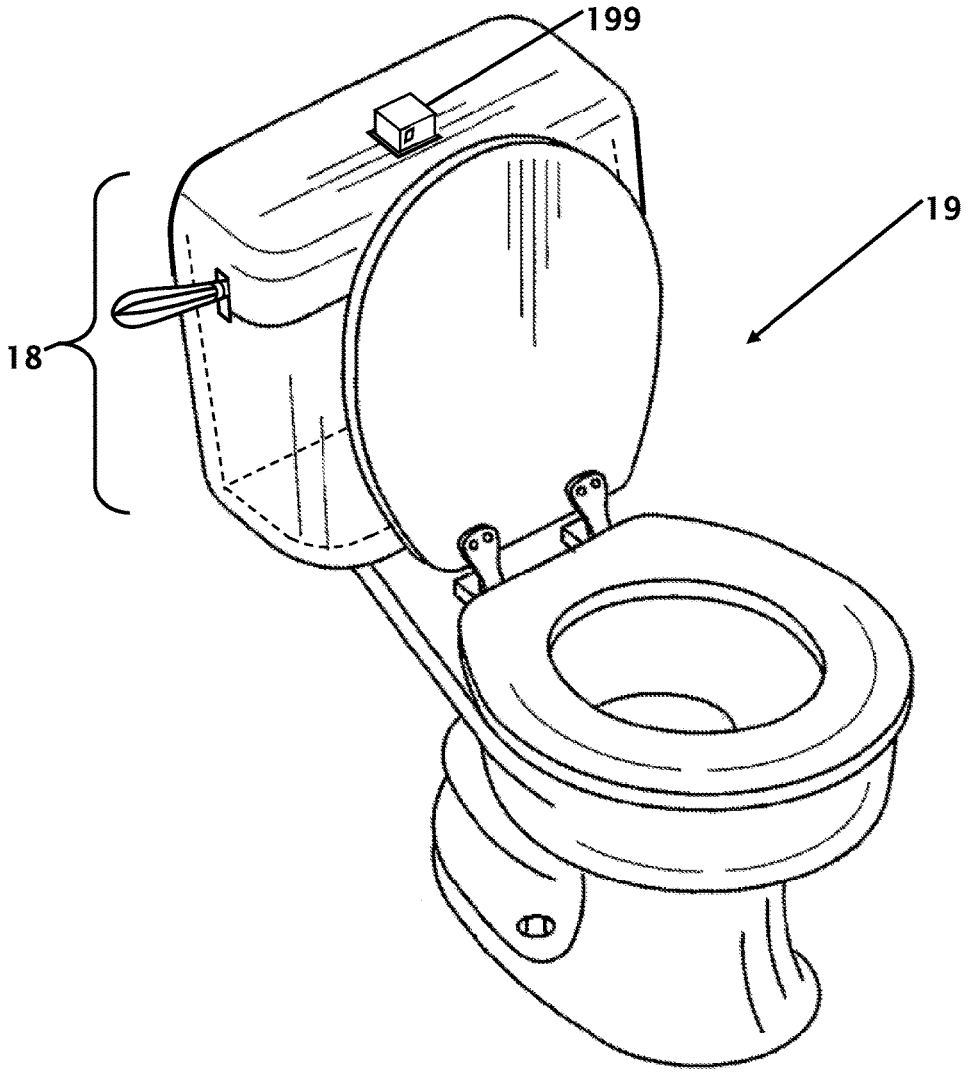
FIG. 1 shows a toilet with the Flush-All 5 installed.

FIG. 1 shows a toilet with the Flush-All 5 installed. The All-Cover 18 is slipped-on or retrofitted onto just the top of the toilet 19 and essentially replaces just the tank 18 portion of the toilet 19. This figure shows the motion detection window 199 with the motion sensor protruding through it. The preferred material for this sealed Direct Water Pressure Tank (DWPT) ALL-TANK device is rust resistant stainless steel metal since the buyer would probably never need to replace it and an initial investment is worth it. Other material can be used to reduce the cost or to ease production difficulty and appeal to those who cannot afford the higher prices of the stainless steel version. Those other material can be a high impact plastics or some other heavy duty hardy polymers. Regardless of the material used it must be durable enough to withstand fatigue and the test of time.

Figure 2:
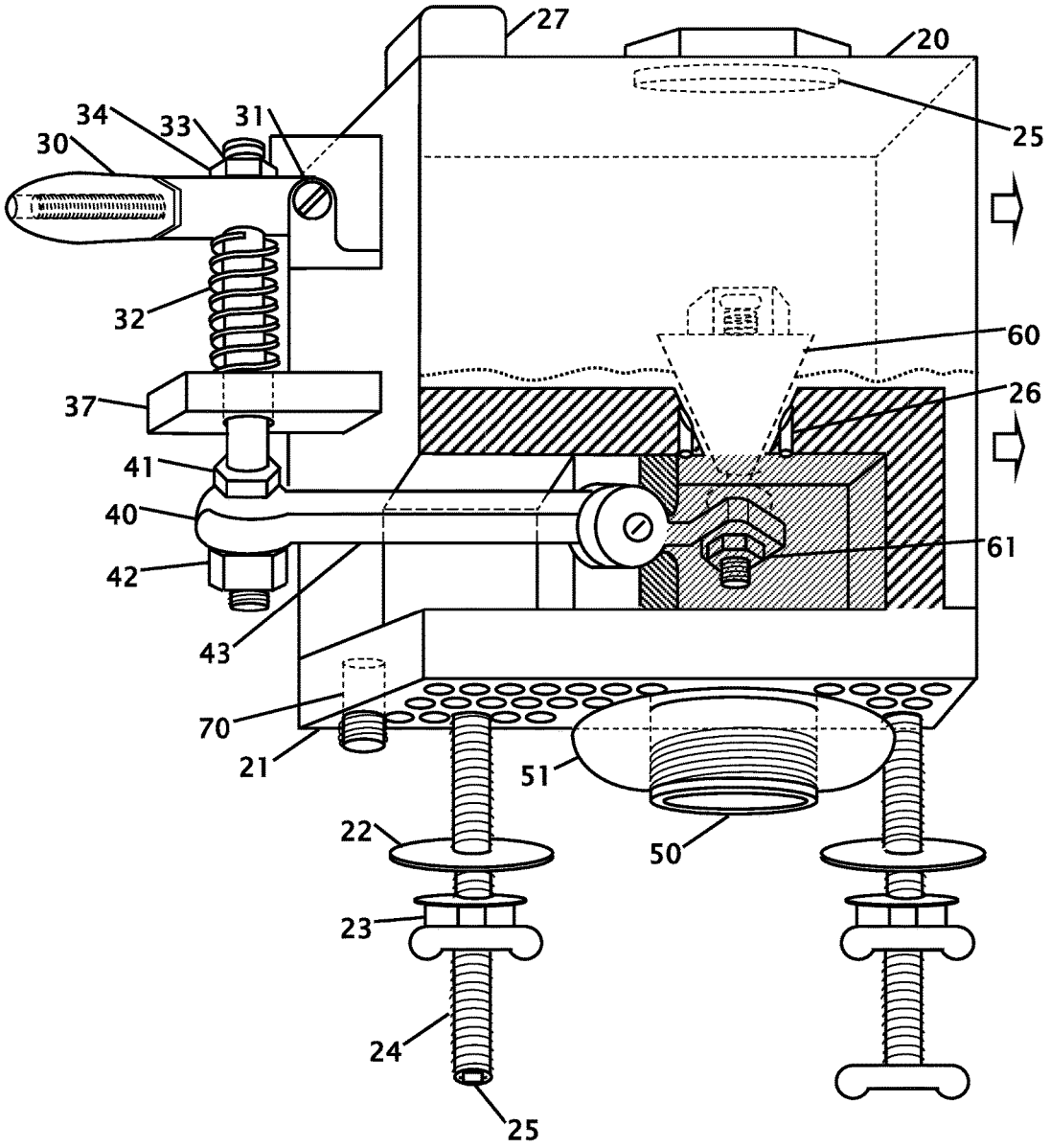
FIG. 2 shows an overview of the Flush-All 1 version.

FIG. 2 shows an overview of the Flush-All 1 system. In this Flush-All 1 version, the Flush rod 33 is outside of the water tank 20. This version contains the only toilet tank/bowl system anywhere with the flush rod that is located outside of the water tank. It is contemplated that the sealed tank 20 is approximately 14 inches wide by 4 inches deep, but the height dimension or other dimensions can vary based upon the design and the installed toilet bowls. The flush handle 30 is secured with screw(s) 31 or other hardware. The handle 30 is secured to a transfer shaft with a hex nut (34). A spring 32 keeps the flush handle 30 in an elevated position. A horizontal platform 37 that loads the spring 32. An upper nut 41 secures the actuator arm 40 with a lower nut 42 for adjustment of the position of the actuator arm 40. Both nuts 41 and 42 have rounded (torus shaped) one side and hex shaped on the other side. Rocker joint rod 43 operates between the flush rod 33 and the conical shaped washer 60. The bottom 21 of the tank is supported with a universal mounting Base (ALL-UNIVERSAL MOUNTING BASE).

This base contains many nut like blind end holes openings size 5/16" or others facing downward to allow for an easy alignment of the different brands of toilet bowls holes with the different positions of those nut like holes. The tank sealed 20 is secured to the toilet bowl with a 5/16" or, other sizes as required, by the threaded shaft All-Bolt 24 size 5/16" or others, having either a wing nut or a plurality of different slots 25 to accept slotted screwdriver, Philips or a hex wrench. There is a rubber 22 washer and a wing nut All-Nut 23 size 5/16" or others (or similar All combination nut) for securing the tank 20 to the bowl. Universal (All-Nut) 23 is a combination of wing nut/hex nut/washer all cast into one piece. It allows for securing the water tank to the toilet bowl. This All-Nut is used to brace the tank to the toilet bowl and the wing nut is to hand tighten the All-Bolt 24. I added the hex nut design on the All-Nut 23 to help people whose hands are too weak to secure the tank to the toilet bowl with hands alone. This way they can use a wrench and carefully tighten the ALL-NUT. The rubber washer 22 is used to hold the threaded shaft 24 to the toilet bowl while being aligned to the water tank for the initial installation. Another unique feature of the Flush-All is the connecting bolts between the water tank and the toilet bowl being completely outside of the water tank. Conventional water tanks connect to the toilet bowls with bolts that are inserted inside of the water tank. This way those bolts are exposed to the corrosive nature of water and the many chemicals people place in the tank to clean their toilet bowls.

The bottom of the tank has a tube for water to flow 50 with a rubber seal 51 that seals the tank to the bowl. Tube 50 has a threaded end to accommodate a screw on pipes for toilet bowl models that has water tank mounted high on walls or have an incoming flush water inlet that does not face upward. Assembly nut 61 (same as 41 and 42) secures the Conical shaped washer 60 (ALL-WASHER). This washer can be coated with rubber, silicone, nylon or even metal (like in coated brass in ball valves). Designed to precisely seal water flow and prevent accidental misalignment. This conical shape is used to increase the total contact surface between the sealing surfaces (the tank and the washer). By increasing the contact surface the chances of water leak is reduced. Item 26 shows a flush water flow channel. The conical shape design is a self-guiding so it increases the chance of proper seating of the washer against the tank like in seating a thimble on a finger end or a dental crown on a prepared tooth. It also uses the water pressure and flow direction of the water to push the washer into the shut off position in this preferred embodiment of the Flush-All 1. The top of the tank has a screw-on water tight cap 25 that is assembled onto the tank to service the tank. An incoming water connection 70 (standard 7/8" or other sizes) is located at the bottom of the tank 20. Item 27 is one of four corner protrusions on top of the tank 20 to stabilize the slip-on porcelain/ceramic All-Cover.

Figure 3:
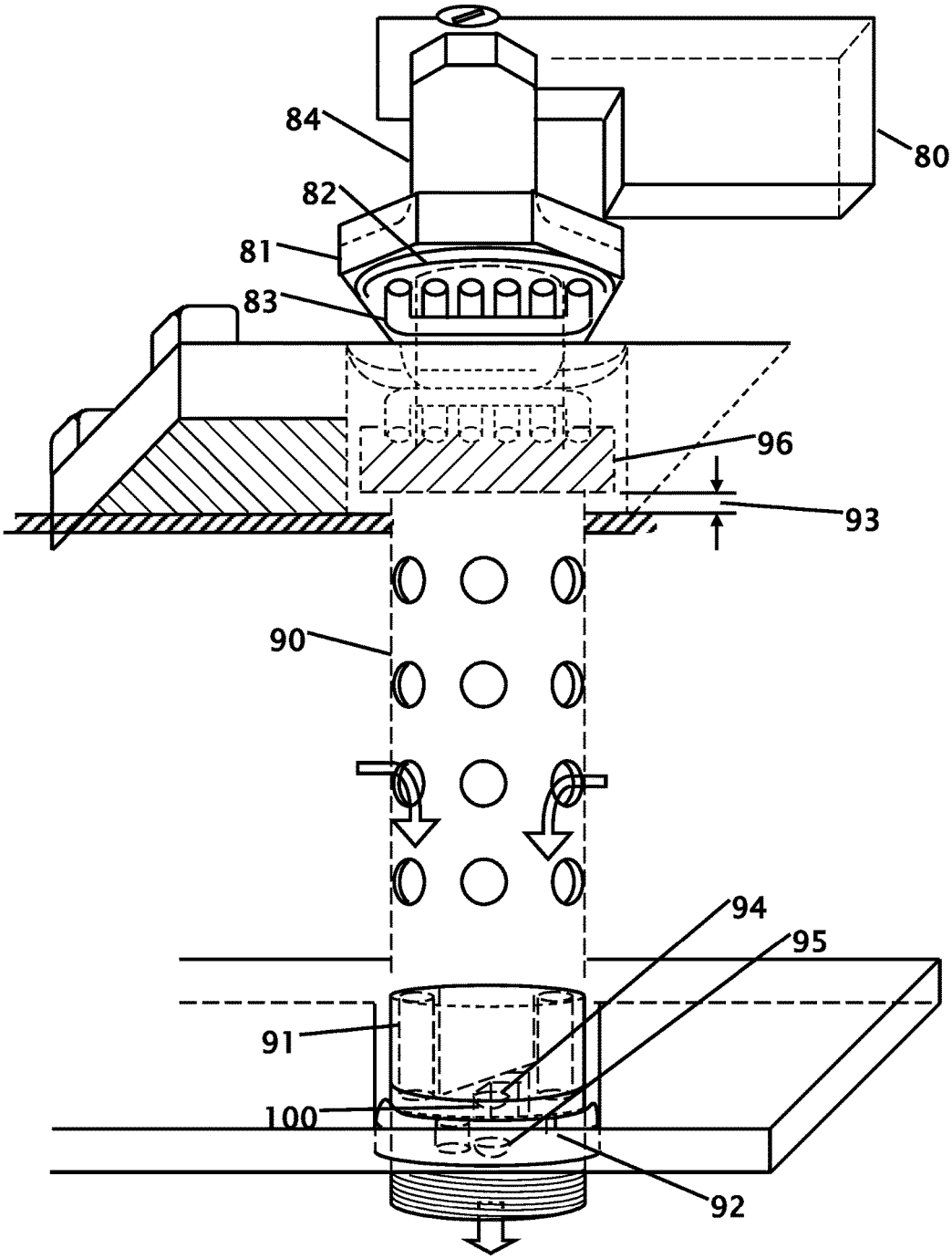
FIG. 3 shows a Flush-All 2 version.

FIG. 3 shows a Flush-All 2 version. The top of the Flush-All has a screw-on handle 80 that can be rotated on a hex shaped end of the rod 84 to rotate the handle. The screw-on nut 81 (union joint) is used to seal the tank and has a number of holes 82 that engage into the spring that resets the valve to the closed position. There is a gap 93 that allows downward pressure. Openings 91 in the central tube 90 allows the flush water flow. Water flows when the hole 91 or holes align with the hole or holes on the base portion 92 of the rotating joint when the flush handle 80 is pushed back or pulled forward. Rotating pivot 94 engages socket 95 to keep the center tube from side-slipping or misalignment as shown and described in FIGS. 13A and 13B.

Figure 14:
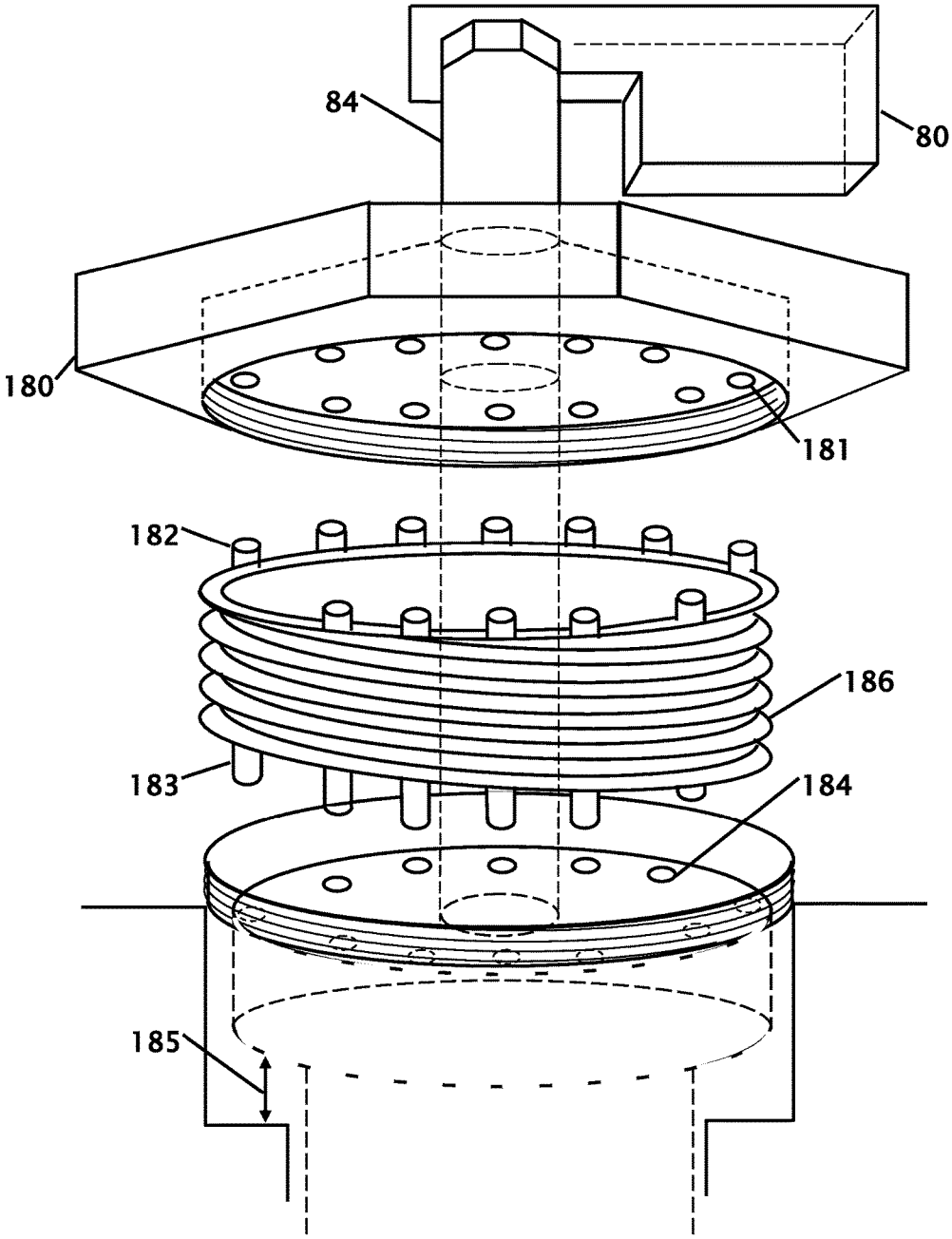
FIG. 14 shows the All rotating, push down joint.

A stop 100 is used to control the range of the rotating joint. This is determined by a pie shape that is cut into the rotating joint central moving part. This stop 100 is built into the base of the water tank. The stop will also allow the loading of the all multi-pronged spring on the top as shown in FIG. 14. The water flows when the openings in the Flush-All rotating joint lines-up with the openings at the base of the sealed direct water pressure tank (DWPT).

When the push back flush handle 80 is momentarily rotated, the lower rotating joint is moved into the open position (i.e. water flow). All spring 83 is shown with multiple prongs on the top and bottom. The All non-flow 96 through rotating joint that is fused to central tube and does not rotate on the tube, with a hole or holes on top of it to engage a spring that forces the lower rotating joint to rotate to the shut-off position, (i.e. the hole opening at the base of the sealed DWPT ALL-TANK not-aligned with the hole in the rotating joint).

Figure 4:
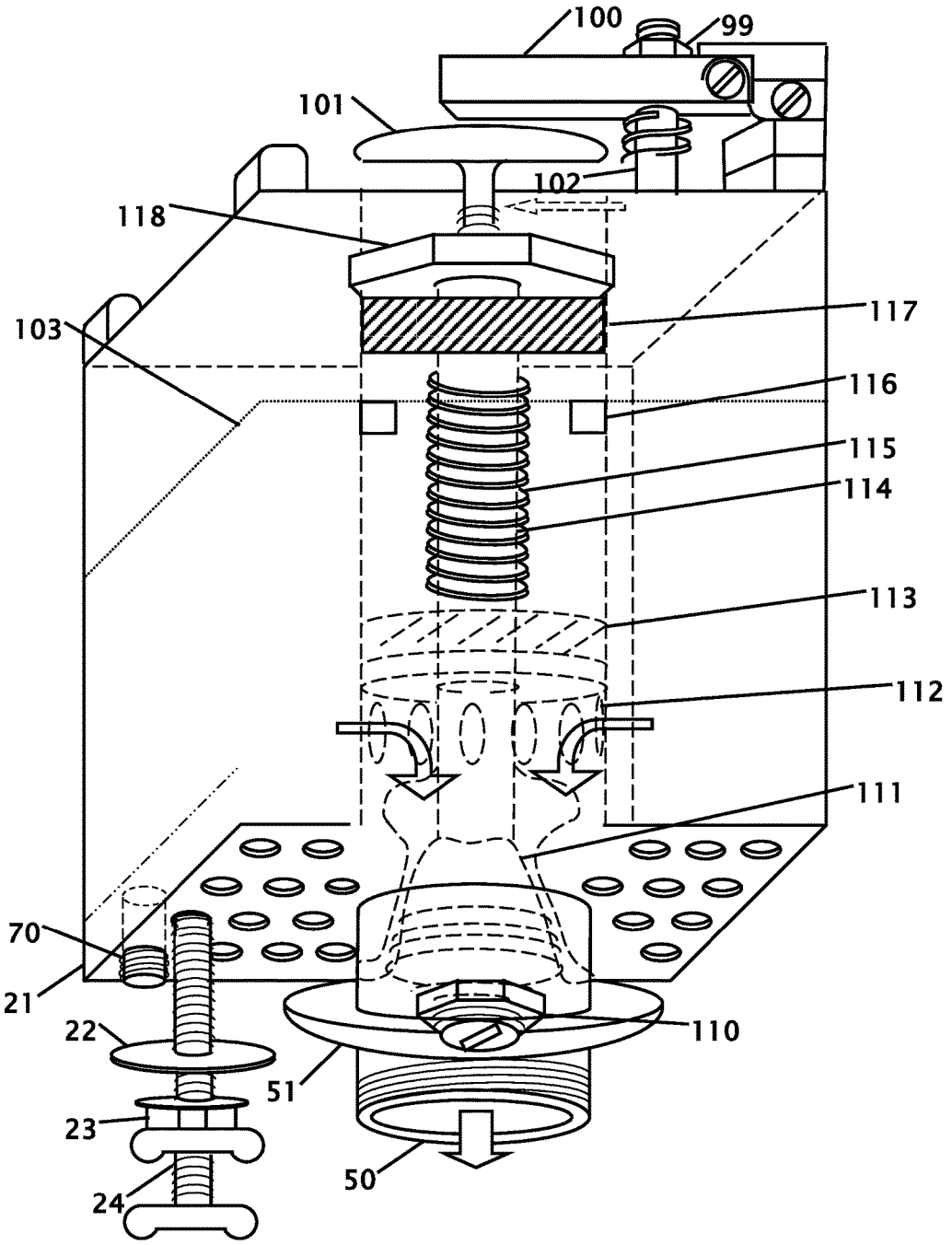
FIG. 4 shows a Flush-All 3 version.

FIG. 4 shows a Flush-All 3 version. The handle 100 or 101 is connected to a flush rod 102 or 114 with a nut 99 or other mounting hardware. The All-Joint 117 can rotate and moves up and down with the joints shown and described in FIGS. 8, 12A and 12C. This All-Joint 117 is fused with the flush rod 114. The water line 103 has pressurized air above and water below the water line 103. The city water connection is shown 70 (standard 7/8" or other sizes) for the water connection. The base of the tank 21 is secured to the toilet bowl with a 5/16" threaded shaft 24 having either a wing nut or a plurality of different slots to accept slotted screwdriver, Philips and/or a hex wrench. There is a rubber 22 washer and a wing nut 23 (or similar all combination nut) for securing the tank to the bowl. Universal (ALL-NUT) 23 is a combination of wing nut/hex nut/washer all cast into one piece.

The bottom of the tank has a tube for water to flow 50 with a rubber seal 51 that seals the tank to the bowl. An assembly nut 110 secures the bottom of a Flush-All washer assembly 111 that is shown and described in FIG. 7. The assembly pipe 112 has holes that allows water to flow into the bowl. Spring stop 113 provides spring pressure to load the flush rod and create a watertight chamber for the spring interface. This spring stop 113 is fused to the tube wall, but allows the flush rod 114 to slip through it. Coil spring 115 pushes back up the flush rod 114 with the fused 117 joint and stops water flow through the toilet. The internal area of the flow tube is sealed from water to prevent water from damaging the spring. A water tight nut 118 caps the assembly and allows for an opening to service the valve. The flush mechanism is shown in two different styles as a handle 100 or as a push-down flusher handle 101, based upon the design and cosmetic requirement.

Figure 5:
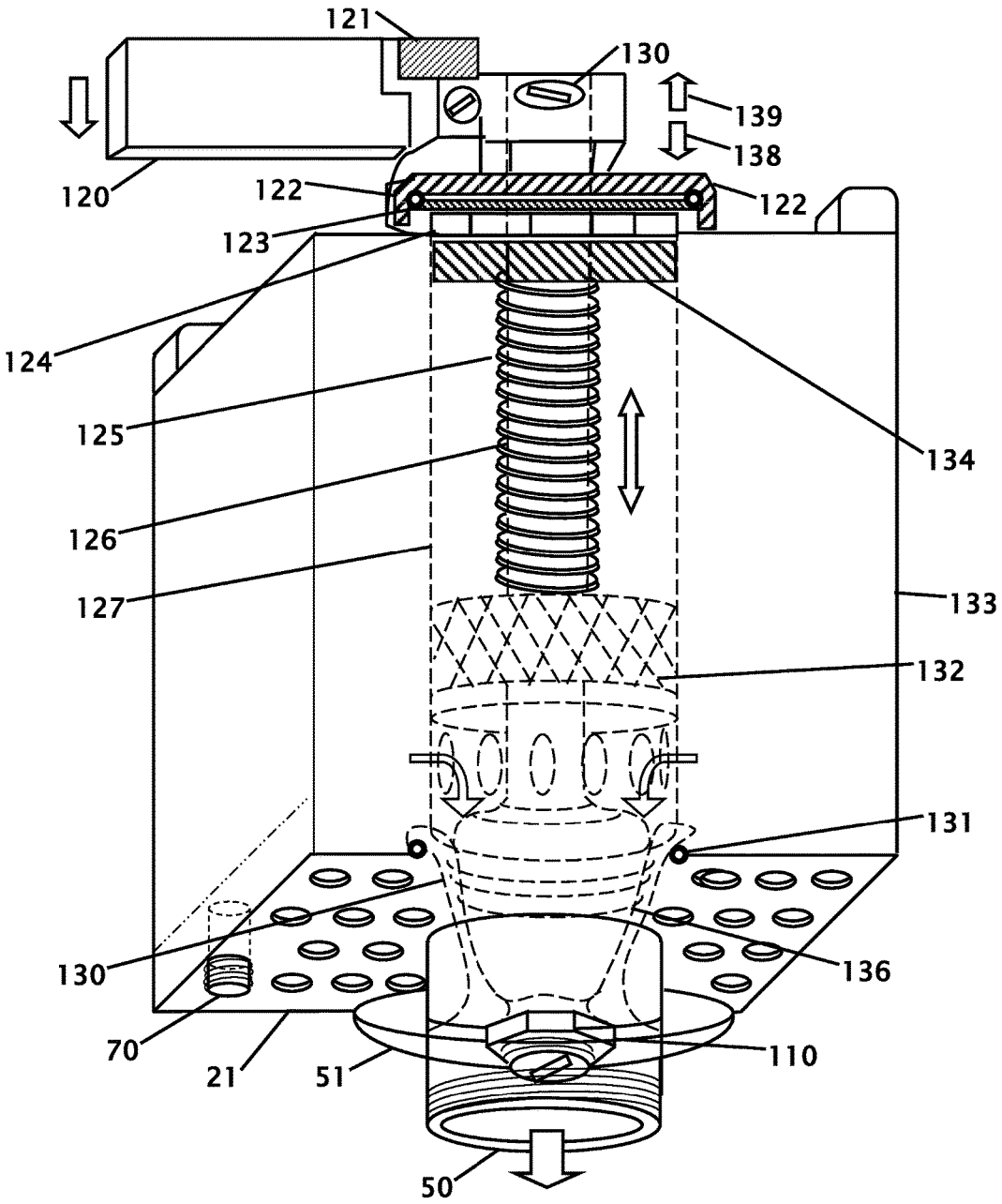
FIG. 5 shows a Flush-All 4 version.

FIG. 5 shows a Flush-All 4 version. In this embodiment the flush handle 120 has a flush handle stop 121 that prevents the handle 120 from lifting too far. A screw 130 retains the flush handle 120. A screw cap 122 and an O-ring washer 123 seals the top of the flow assembly. A hex shaped end 124 is used to tighten and hold a removable central pipe 127 to the water tank at the base. This hex shaped end 124 is designed to be used with an adjustable wrench to tighten the removable central pipe to the base of the water tank. The actual screw assembly is at the base of the tank. A flush rod 126 lifts 139 and lowers 138 the internal assembly and compression spring 125 keeps pressure on opposing ends of the flush assembly. The water connection 70 (standard 7/8" or other sizes) is also shown in this figure. A screw on the main removable central pipe is sealed with an O-ring washer 131, at the tank base. The bottom of the tank has a tube for water to flow 50 with a seal 51 that seals the tank from the toilet bowl. The bottom of the tank 21 is shown with the All Universal Mounting Base previously shown and described.

Figure 7:
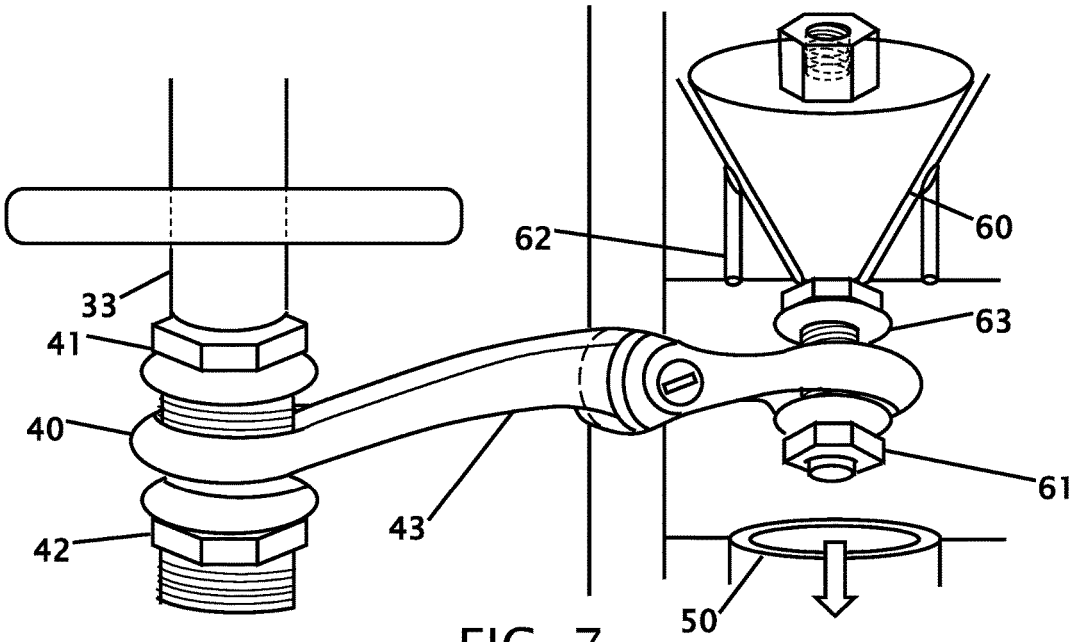
FIG. 7 shows Flush-All washer rocker assembly.

A Flush-All washer assembly 136 is shaped like a spindle and is shown and described in more detail in FIG. 7.

A water tight piston 132 is attached or fused to a flush rod 126 in the central portion. This rod/piston assembly opens the All-Washer assembly when the flush handle is pushed down. The spring 125 closes the valve when there is no pressure on the handle 120. The top of the cylinder has a water tight spring stop 134. This spring stop 134 is fused to the side walls of the pipe and allows the flush rod to slip through it. The whole central pipe assembly can be screwed on the inside of the sealed water tank 133. The assembly is protected from water leaks into the toilet bowl at the bottom or to the outside on the top or to the spring area by an O-ring washer 131 at the bottom and a hex cap 122 and a combination of an O-ring washer 123 at the top.

Figure 6:
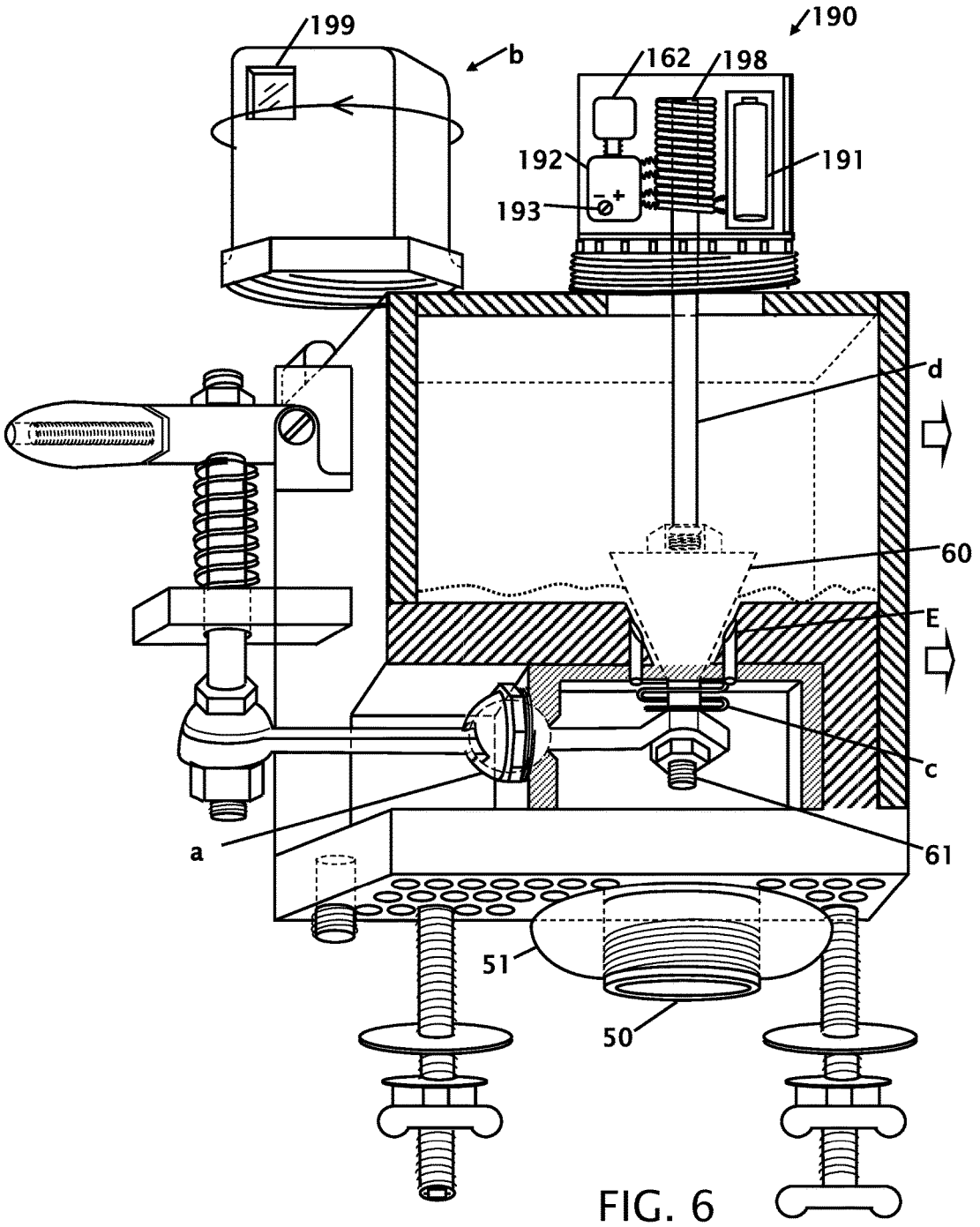
FIG. 6 shows a Flush-All 5 version.

FIG. 6 shows a Flush-All 5 version. In this version, a ball and socket joint (a) used to transfer the flush handle down push to open (push up) the All-Washer and allow the flush water to flow. The cover of the ball and socket joint has a window cut into the cover that controls the range of motion of the horizontal flush actuator rod. The top position for horizontal rest position limit. The lower position to limit the travel distance of the actuator rod during flush activation. The side positions prevent the side to side movement of the rod during the flush activation. An All-Washer loading spring (c) is mounted below this washer assembly. Item E is a flush water flow channel.

The top of the All-Washer is connected to the top mounted version of the motion sensor 190 with housing (b). The motion sensor with two versions side and top mounted. Flush-All 1 version has the side mounted and 5 version has the top mounted motion sensors for the option of a motion detected flushing. This top mounted motion detector can be added or removed as an option per user's demand. The porcelain cover on this version has a square opening that slips around the top mounted sensor. (As described with FIG. 10) This sensor consists of a battery 191 operated electromagnetic coil 198 that exerts an electromagnetic pull on a pole that is positioned in its center (d). This pole is mechanically screwed into the top of the All-Washer. When this coil is activated it would pull this pole upward. This pole (d) then pulls up the All-Washer. This upward pulling of the All-Washer would activate water flushing cycle. This momentary upward pull of the pole caused by the battery activating the electromagnetic coil with a circuit board 192 controlling the length of the activation (i.e. 5 seconds, 10 seconds etc. by adjusting a potentiometer 193 to the desired length of the flush cycle) a water is flushed down the toilet bowl.

At the end of the activation cycle the battery current to the coil is cut off and the spring load below the All-Washer pulls down the pole into the shut off position. The motion sensing window 199 and the motion sensor 162 with the whole circuit board assembly 190 can be rotated in a horizontal plane to any position or direction desired by the user. By positioning this sensing window 199 to the side, instead of the forward facing, it would prevent accidental flushing as the user prepares to use the toilet bowl.

FIG. 7 shows Flush-All washer rocker assembly. The All-Washer is made up a conical shaped washer that is a cast metal. This washer is cast into one-piece with a hexagonal (with threads in the inside) portion above it and a rod below it. The hexagonal shape protrusion above the All-Washer is not a nut, but is designed to allow for the stabilization of the All-Washer as it being screwed with the assembly nut 61 to the flush handle actuator arm below. The threads inside of this hexagonal portion is to screw-in the rod for the motion detector on top of the device. This washer shut-off system also has the simplest design of the mechanical movement where just a slight dislodging (no real movement) so no chance of wear-out or jamming. The sealing member 60 has a tapered spindle shape and is coated with rubber, silicone, nylon, brass or other equivalent material. This component is made from metal and it is specially coated for durability like in a ball valve to prevent fluid leak or wear. Item 62 is a flush water flow channel.

This All-Washer is connected to the actuator arm by a simplified connection and is positioned between 61 and 63 washers that guides its up-and-down movement. This type of movement prevents the use of an actual joint connection that would eventually get water deposits that could build-up and/or get sticky. The flush rod 33 has the actuator arm 43 retained with All-Hex nuts 41 and 42. These nuts have a rounded one side and hex shaped on the other side and are adjustable to set the position of the actuator arm 43. Those screw-on nuts are adjustable to control the travel distance of the actuator arm 43. Screws 61 and 63 is an All-Hex nut (is the same as 41 and 42) and is fabricated with a special curved or torus shaped one side and hex shaped on the other side to allow for gliding of the actuator arm 43 up and down to open the spindle shaped All Washer 60 to allow a momentary water flow.

Figure 8:
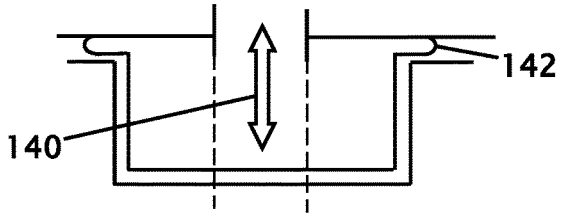
FIG. 8 shows the All rotating joint.

FIG. 8 shows the All rotating joint. The Flush-All rotating joint allows liquid 140 to flow. The rotating joint is coated metal to metal or other material that allows rotating or sliding motion to slide up and down the joint. This must be fluid tight to allow rotation (flow through) or up and down (non-flow through) joint with or without a lip 142.

Figure 9:
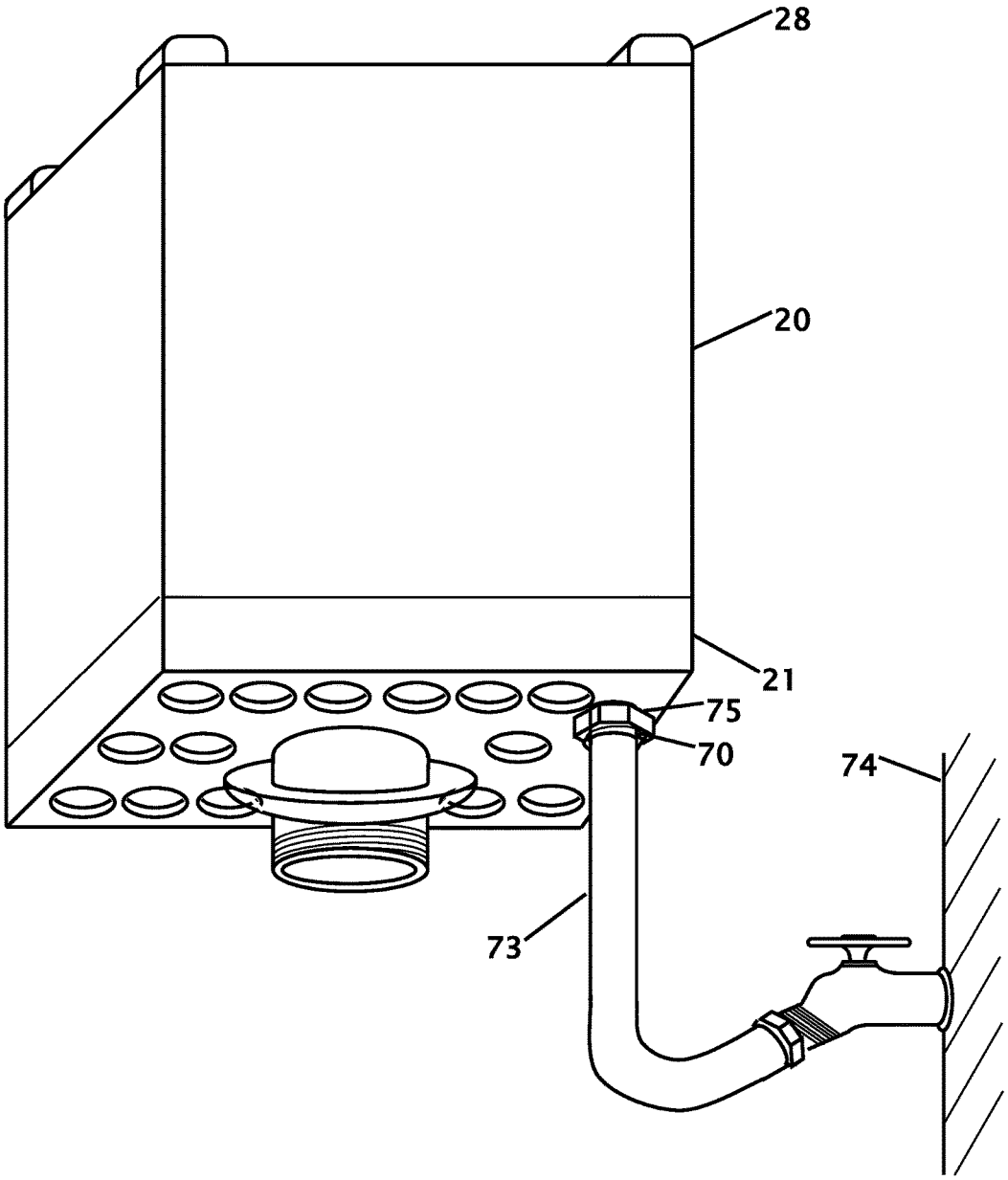
FIG. 9 shows the back of the sealed Direct Water Pressure Tank (DWPT) ALL-TANK.
Figure 10:
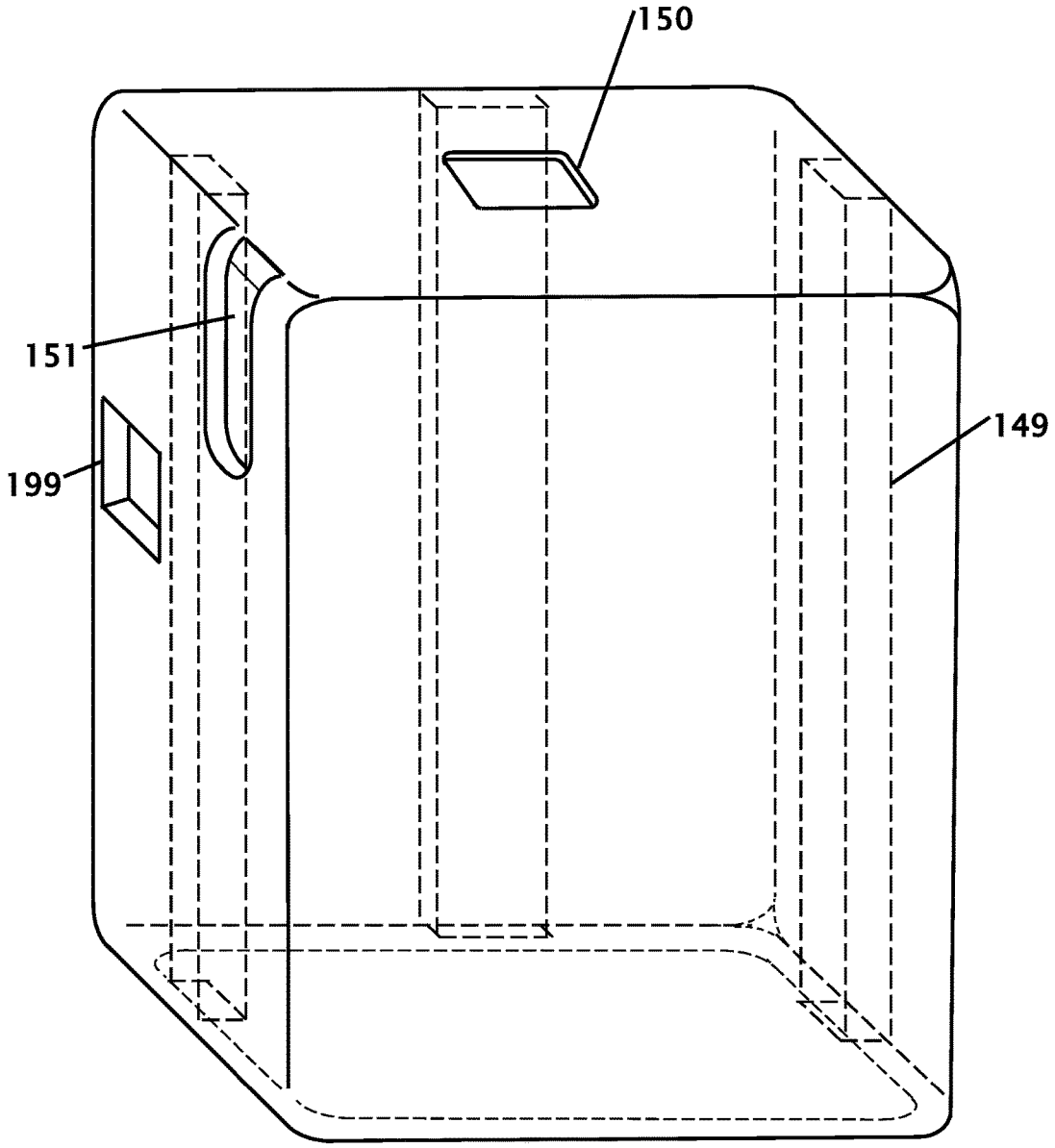
FIG. 10 shows a front view of the ceramic/porcelain slip-on cover (All-Cover).
Figure 11:
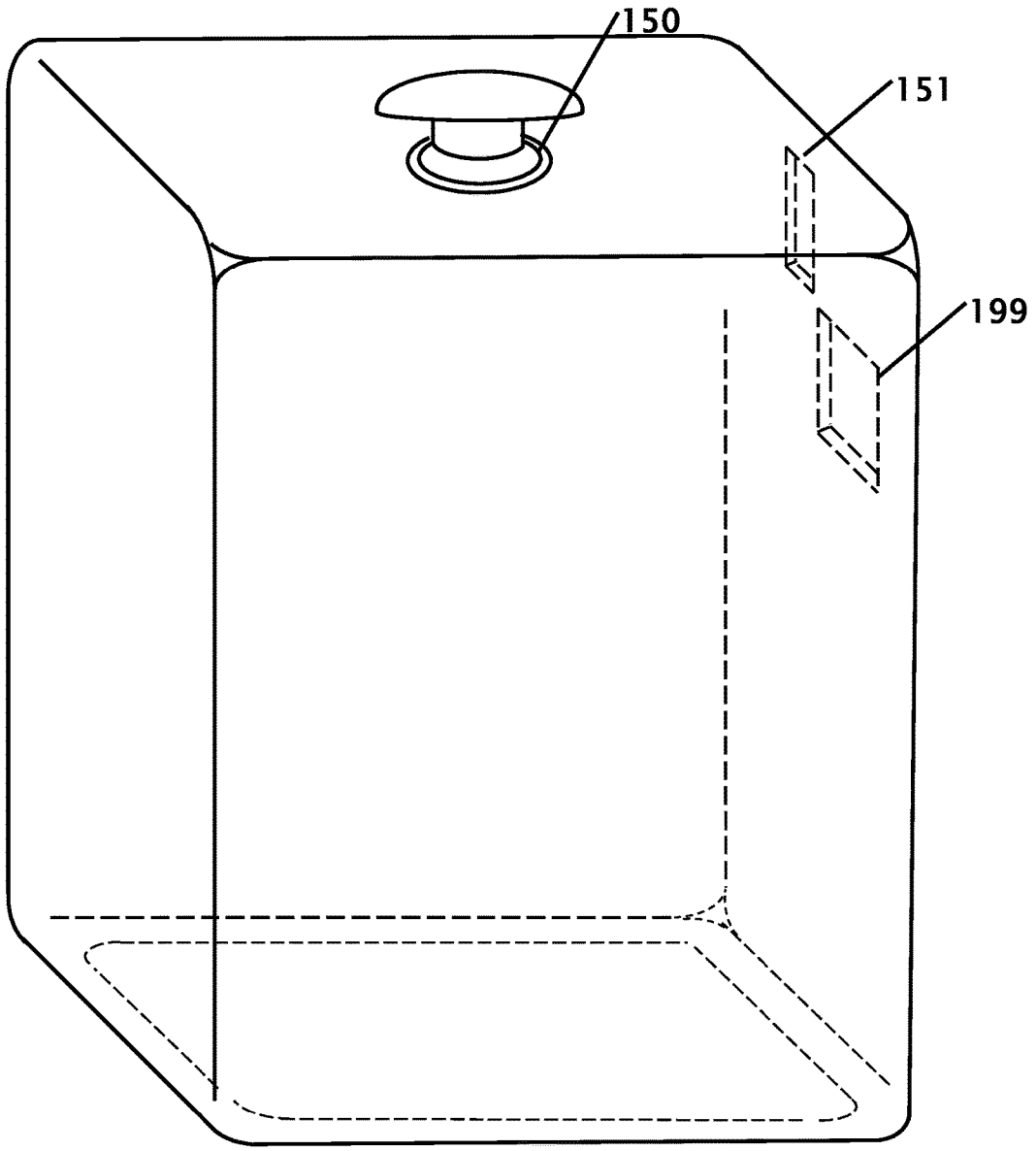
FIG. 11 shows a back view of the ceramic/porcelain slip-on cover (All-Cover).

FIG. 9 shows the back of the sealed direct water pressure tank (DWPT) ALL-TANK 20. The city connecting water line 73 from the house or building 74. The fitting 70 (standard ⅞" or Other sizes) from the water supply to the tank 20 connected at the bottom of the tank. The bottom 21 of the tank 20 is supported with a universal mounting Base (ALL-UNIVERSAL MOUNTING BASE). The water line is a standard ½" or other sizes with a screw-on fitting coming from the city water connection. The pipe 73 connects to the end of the fitting 70 with threaded connection 75. Corner protrusions 28 on the top of the tank are for stabilizing the slip-on All-Porcelain cover FIG. 10 shows a front view of the All ceramic/porcelain slip-on cover and FIG. 11 shows a back view of the All ceramic/porcelain slip-on cover. The Flush-All can be fitted with a slip on Porcelain/Ceramic cover (ALL-COVER). The top opening 150 can be rounded to provide clearance for the top flush buttons or handles previously disclosed (Flush-All 2-4). This top opening can also be square shaped to accommodate the top mounted motion sensor in Flush-All 5 version. The side opening 151 provides clearance for side mounted flush handles previously described. The handle pass through this opening. The second side opening 199 is also sized to allow for detection of hand motion. In Flush-All 1 version there is no opening 150 on the top of this cover. In this FIG. 10, item 149 is the porcelain/ceramic protrusion inside of the All-Porcelain slip-on cover. This protrusions can be on one side or on multiple sides to help stabilize the All-Porcelain slip-on cover and prevents side-to-side movement.

Figure 12A:
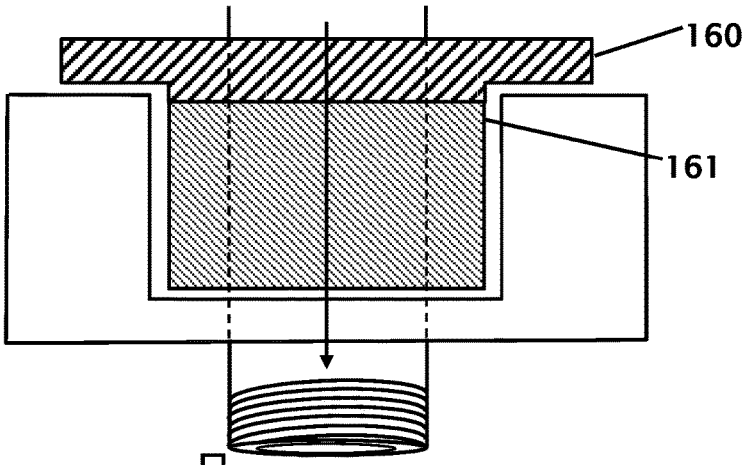
FIG. 12A-12C shows the All rotating joint.
Figure 12B:
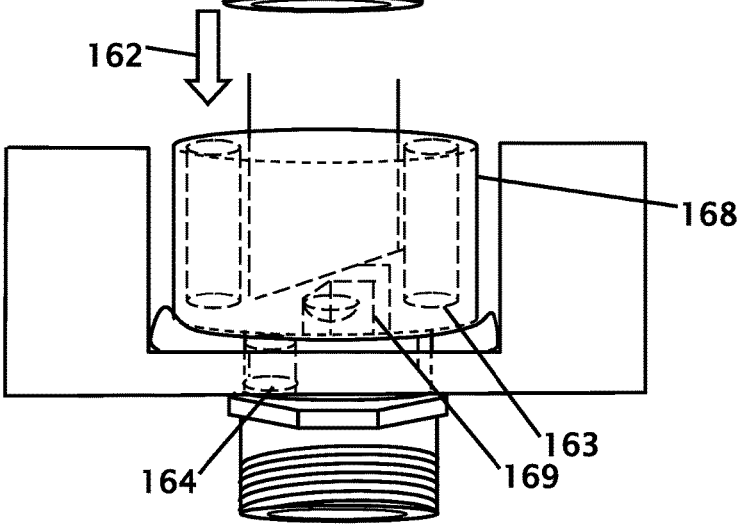
Figure 12C:
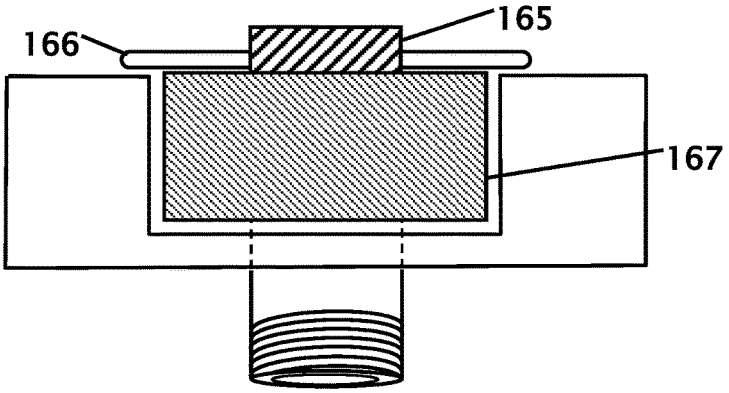

FIG. 12A-12C shows the All rotating joints. The joints allows rotating flow through and no flow through. The top of the valve has a lip 160. In FIG. 12A, the piston 161 is water tight fit and similar to a ball valve. It is made off coated metal (i.e. brass) or and other durable material. This joint allows for liquid to flow through the connection while it is rotated.

This allows pressurized flow of water while it is water tight. This joint can also be made with a lip or without a lip. In FIG. 12B, rotating with holes for water flow 162 through the rotating joint 168 with rotating on/off. The piston like tight fit with through holes. When holes 163 in the piston 168 align with holes 164 in the base fluid flows, when not aligned, flow stops. The rotation stop 169 is designed to create a range for rotation that is determined by a wedge cut into the rotating piston 168. The stop is part of the base and not the piston. In FIG. 12C the rod 165 rotates and moves up and down and is sealed with an optional lip 166. Rotating and moving up and down the piston 167 provides a fluid tight junction and is simply rotated or moved with an up or down motion without any fluid flowing through it.

Figure 13A:
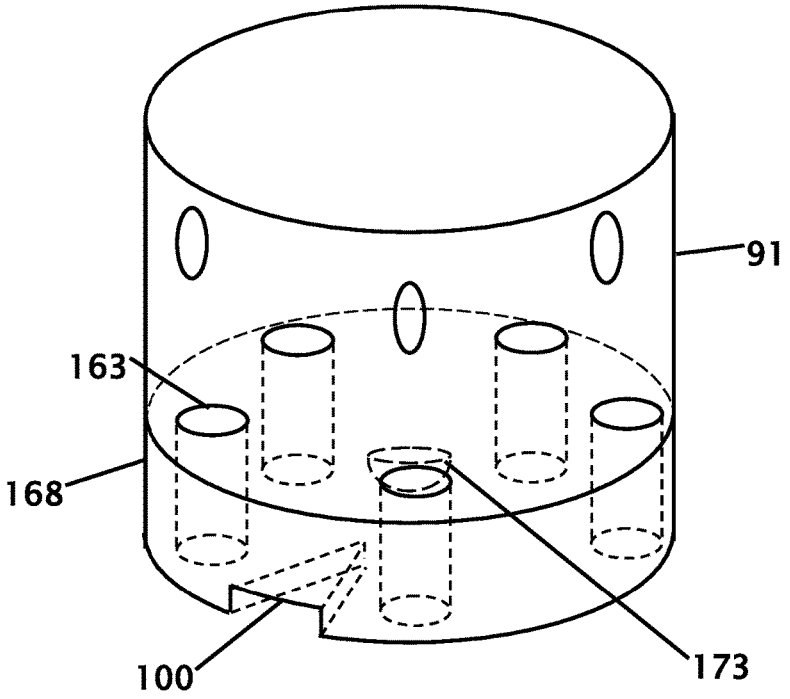
FIGS. 13A and 13B show the All-rotating joint with holes.
Figure 13B:
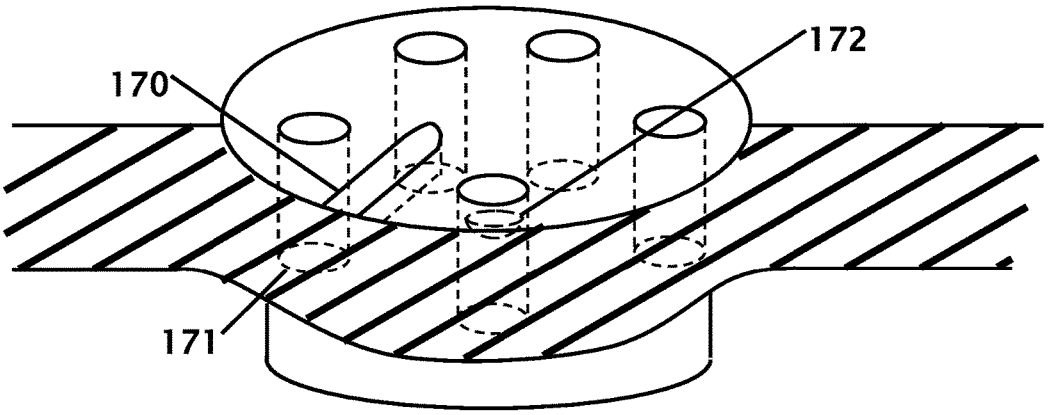

FIGS. 13A and 13B show the All-rotating joint with holes. The rotating and push down flush rod 91 is shown with the piston 168. The pie cut 100 in the convex portion of the lower rotating valve that limit rotation between an on and an off position and engages the stop 170 at the lower portion of the joint. The stop 170 is built into the concave lower portion that engages the pie cut portion of the upper convex portion of the joint. Flush water flows through openings 171 when aligned with holes 163. Pivot 173 engages socket 172 to prevent side slipping of the flush rod 91 when the toilet is flushed.

FIG. 14 shows the All rotating, push down joint. The push-back flush handle 80 is shown at the top of this figure. An All hex nut 180 (union joint) is a water tight hex screw cap on the top of the water tank and engages the All spring 186 and provides a spring load as the nut 180 is tightened. The top and bottom of the All spring 186 has tabs 182 and 183 that engage into holes 181 and 184 in the nut 180 on top and the non-flow through joint at the bottom, respectively. The all spring 186 has multiple prongs 182 and 183 on the top and bottom to engage the cap on the top and the All rotating up and down joint at the bottom. This spring will exert both rotational and up and down strength (force). A gap 185 in the joint allows the spring to exert downward force on the rotating flush rod.

Figure 15:
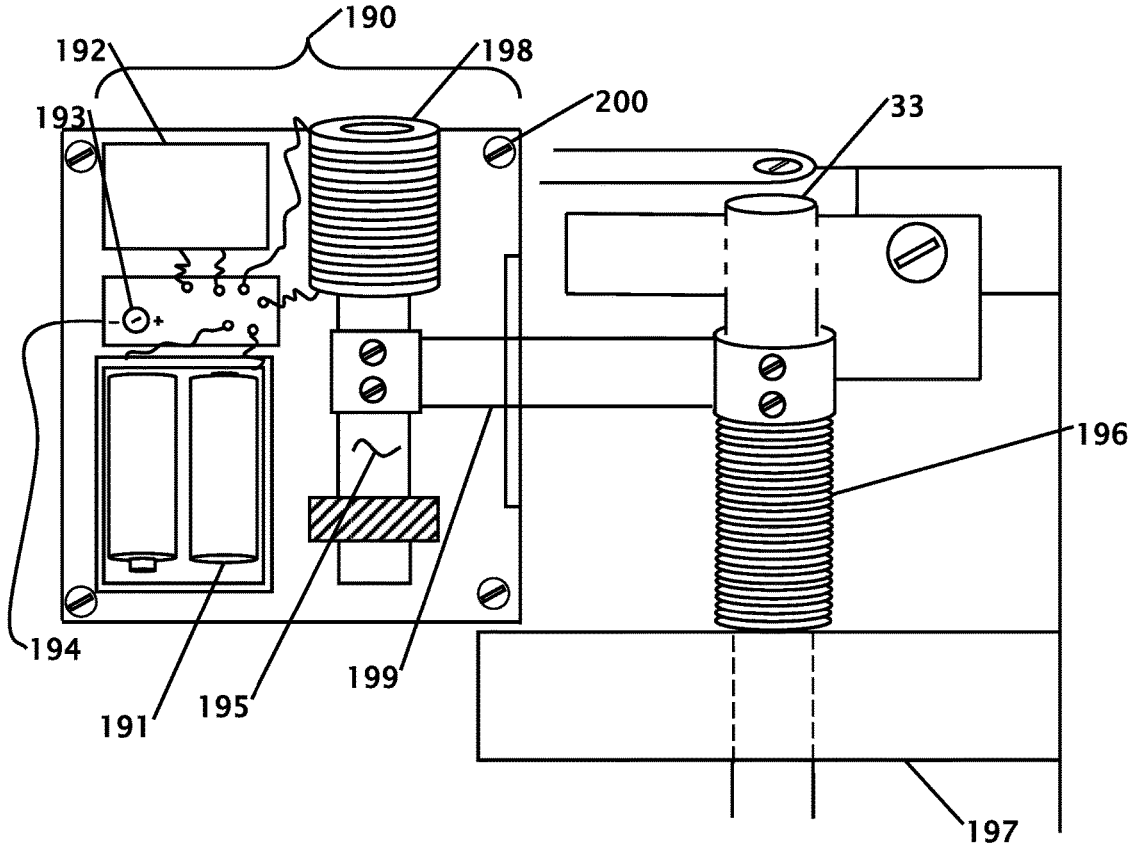
FIG. 15 shows the motion detection attachment connected to Flush-All 1 version.

FIG. 15 shows the battery operated motion attachment 190. FLUSH-ALL 1 has an option of a side mounted motion detected 192 flushing. This one consists of batteries 191 that operate an electromagnetic coil 198 that exerts a repulsive (same magnetic polarity) on a pole 195 through a bridged connection 199. This would push this pole 195 downward. This pole 195 is mechanically connected by cross bracing 199 to the flush rod 33 in the Flush-All 1. This momentary downward push of the flush rod 33 caused by the battery 191 activating the electromagnetic coil 198 with a circuit board 194 controlling the length of the activation or flush duration (i.e. 5 seconds, 10 seconds etc.) a water is flushed down the toilet bowl. A rotating potentiometer 193 adjusts the length of the flush cycle duration. At the end of the activation cycle the battery 191 current to the coil 198 is cut off and the flush rod spring 196 load pushes the pole 195 through the bridged connection 199 back inside the coil 198 as the final resting position. A stop 197 provides spring load 196 and prevents over travel of the flush rod 33. 200 is/are mounting screws.

This motion sensor is mounted on the side of the tank instead of facing forward this way no accidental flushing takes place while an individual is getting ready to use the toilet. A motion of the hands on the side of the tank will activate the flushing. This way the user has a total control over whether to use automatic flushing or manual flushing.

Figure 16:
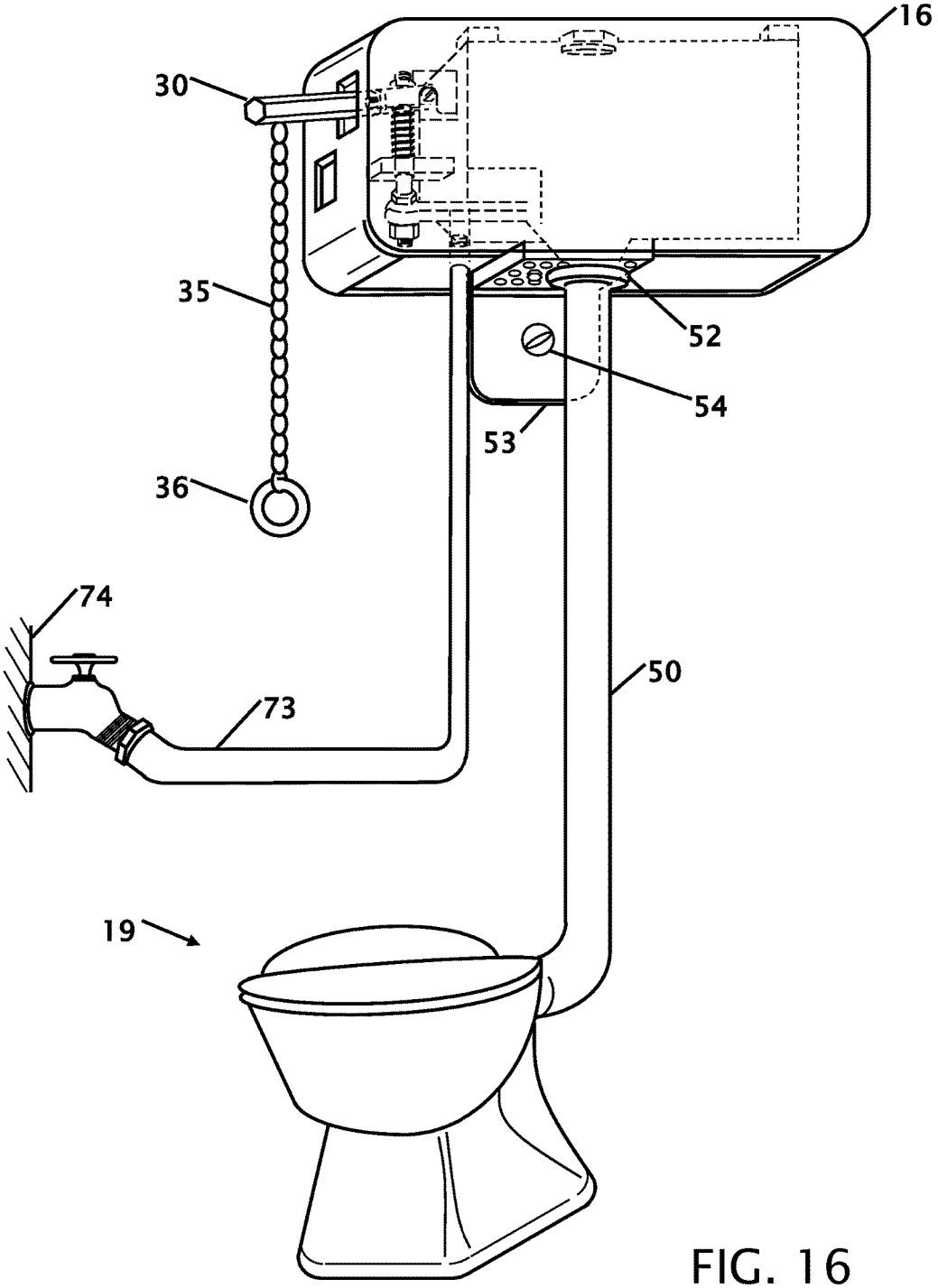
FIG. 16 shows the wall mounted version.

FIG. 16 shows the wall mounted version. This figure shows an overview of the wall mounted toilet tank equipped with Flush-All 1 apparatus and is described further herein.

Included is the Design (Figures/Diagrams) with the description of a new toilet water flush system I called FLUSH-ALL. Accompanying this disclosure are Figures that describes the design and functions of this invention. This is a revolutionary invention designed to flush toilet, with major advantages over existing systems. The sealed water tank is connected directly to city water so I named it Direct Water Pressure Tank abbreviated as (DWPT). It uses three different types of forces to flush the toilet:

A. Direct incoming water pressure.

B. Gravitational weight of the content of the water tank.

C. Pressurized air which was trapped in the tank while being refilled from the bottom up.

This disclosure includes figures/diagrams for five different variations of this tank I called them FLUSH-ALL 1 through FLUSH-ALL 5. This FLUSH-ALL tank can be made in different shapes and sizes or materials to accommodate the different shapes and designs of the existing toilet bowls so as to make it easy to retrofit to those bowls without replacing the whole toilet bowl system only the tank. Regardless of the shape or the size of those water tanks, the flush mechanism and the attachment mechanism to the toilet bowls, is by using the same principle in all of them. This is accomplished by a momentary opening of a valve to allow pressurized city water to flow into the water toilet bowl. This system basically works on demand (instant on and instant off). The user has a full control over its flushing process. You do not need to use 1.6 or 1.2 gallons every time you flush. The user will determine exactly how much water to use at each and every flush and probably almost never even use a 1.2 gallons. It can be retrofitted to most existing systems by use of the All-Universal mounting base or it can be made as a complete separate toilet bowl fixture. Here are some of the advantages of this system:

1. It saves water because the flush amount is not predetermined by the size of the tank reservoir (i.e. 1.6 Gallon). The flusher holds down the handle for the length of time he or she wants the water to flow. More for larger bowl content less for a minor flush.

2. Forceful flushing. The water pressure of the incoming water with the gravitational weight of the tank water combined with the trapped air pressure determines the strength of the flush. It is not determined only by a simple gravitational flow of the water tank content.

3. Quick flush, as soon as the flush handle is released the flushing stops. No need to contend with noisy water flow that is determined by the time it will takes for the flapper falling down period and water tank refilling.

4. Major water saving device. No sticking of the flushing flapper, leaky flapper, loose flush handle, wasted water flow by improperly adjusted water level height as water continuously flows over the overfill tubing, or defects in the incoming water automatic shut off system or the noise that accompany such continuous flow.

The flushing mechanism in the FLUSH-ALL (my invention) utilizes minimal mechanical & hydraulic interaction. A simple push on the flush handle opens a valve to allow sealed pressurized city water to flow, upon release of the handle the spring tension closes the valve, it is that simple because the conical shaped washer (ALL-WASHER) is made of a coated cast metal the FLUSH-ALL it has virtually no components to wear out. In contrast present conventional toilet bowl flushing systems involve many mechanical and hydraulic interactions to start and end a single flush. The flush handle must be tightly screwed on the porcelain wall and connected on the inside to the flush actuator rod which must be located somewhere above the rubber flapper to work properly. The actuator arm is connected by a metal chain or a rubber strap to the flapper.

The length of this chain or strap is very critical. This is too short then a flapper-drain opening interface will leak water and if is too long no flushing will occur. Different toilet bowl companies utilize different techniques to keep the flapper suspended or afloat in an upright position to allow the complete flushing of the tank. This flapper floating suspension is very inefficient in keeping the flapper suspended long enough that it would allow a large quantity of water to be wasted as the automatic refill mechanism is activated. This refilling does not actually refill the tank until the flapper is back down and there is enough water weight on top of it to force the flapper to seal the drain opening. This wasted water does not help in cleaning the toilet bowl because its pressure has dissipated as it flows on the floor of the water tank. As you see the amount of water wasted is much more than just a simple 1.2 gallons of the tank water. The water tank water level must be adjusted just right. If too high the overflow tube will prevent the auto refill from shutting off, and if is too low people will flush a multiple of times to clear the bowl content causing even more water waste.

Most auto refill devices are prone to deterioration due to being in water 24/7. This would lead to stickiness, jamming and malfunction. The flapper-drain opening interface often leaks small amount of water that is hard to detect visually. This is caused by the flapper warping or build-up of hard water deposit and mold. This would lead to a varicose vein like water deposit stains in the toilet bowl caused by this difficult to seal design. Most conventional water tanks are made of porcelain which makes them prone to cracking or breaking. The fragile nature of porcelain forces manufacturer of water connection lines to use material that are not durable enough to stand the test of time. Those companies are forced to use rubber washers with plastic, vinyl, or other polymers as a water line connector joints because using a solid connector joint like a rust resisting metal joint would cause the porcelain to crack if over-tightened. Most people are reluctant to over-tighten this joint because of fear that they may crack the porcelain water tank which would eventually leads to water leaks as the joint fatigues.

The two brass bolts that holds this porcelain tank to the toilet bowl are in water 24/7. Those bolts become corroded and their washers will eventually leak water because of the corrosive nature of water combined with the damage caused by the many chemical products (i.e chlorine tablets etc.) that people place in the tank to clean their toilet bowls. Keeping a conventional toilet bowl system working properly is a continuous and an ongoing task that takes time and effort not to count repair expenses, wasted water and water damage with resulting health risks.

5. No need to wait for the water tank to stops re-filling in case the flapper gets stuck in the open position as the rubber components wear out being in water 24/7.

6. Prevents one the major causes of water damage to homes and businesses by the overflowing of a defective/damaged conventional toilet bowls water flushing systems.

7. Universal design can be used on most toilet bowls systems, a simple retrofitting procedure using the exclusive ALL-UNIVERSAL MOUNTING BASE design (see description later) that would save the country a lot of water as we encounter more and more drought situations.

8. This is a revolutionary invention because most home and business owners are very reluctant to replace their toilet bowels because it is a costly and messy procedure which involves ripping out the old toilet bowl with carpet, wood, cement or tile removal and reinstalling a new toilet bowl and fixing up the carpet, wood, cement or tiles. Also many people are reluctant to remove their present toilet bowl because it means getting exposed to sewer fumes, mold which is a major health hazard (many people find this objectionable) and needing to replace the wax ring. Standard toilet bowls have a pre filled toilet tank with water. This water is not sealed and this would create an increase in the moisture content in the bathroom in general and around the toilet bowl thus promoting growth of many bacteria and mold. I believe this is the cause of many bathrooms especially the older one of having a musty smell to them.

This system can virtually be retrofitted to any existing toilet bowl. The only part to be replaced is the toilet tank. It is a quick and easy procedure that requires no structural damage or repair to the bathroom. It requires no plumber, anyone with an average aptitude can do it.

The following is a list of unique and patentable features of this device:

A. Conical shaped washer (ALL-WASHER). This washer is made of coated metal like in coated brass in ball valves. Designed to precisely seal water flow and prevent accidental misalignment. This conical shaped is used to increase the total contact surface between the sealing surfaces (the tank and the washer). By increasing the contact surface, the chances of water leak is reduced. The conical shape design is self-guiding so it increases the chance of proper seating of the washer against the tank like in seating a thimble on a finger end or a dental crown on a prepared tooth. It also uses the water pressure and flow direction of the water to push the washer into the shut off position as in version FLUSH-ALL 1. This conical shaped washer allows for wear in, which means as it is used more and more, the washer material wears in to match the sealing surface of the tank. Other pressurized water tank system has additional mechanical movements as the system flushes or refills. This mechanical movement causes wear out of the O-rings, plunger etc. which can lead to sticking, jamming or water leaks. This way they are not an instant on and off or on demand.

B. Universal Mounting Base (ALL-UNIVERSAL MOUNTING BASE). This base contains many nut like blind end holes openings facing downward to allow for an easy alignment of the different brands of toilet bowls holes with the different positions of those nut like holes.

C. Universal Mounting Bolt (ALL-BOLT). Those are the specially built bolts with a wing nut end or with a screw slot to allow for the initial alignment of the water tank with the toilet bowl.

D. Universal (ALL-NUT) is a combination of wing nut/hex nut/washer all cast into one piece. This ALL-NUT screws into the ALL-BOLT to allow for securing the water tank to the toilet bowl. The washer is to brace the tank to the toilet bowl and the wing nut is to hand tighten the ALL-NUT on the ALL-BOLT to the toilet bowl. I added the hex nut design to help people whose hands are too weak to secure the tank to the toilet bowl with hands alone. This way they can use a wrench and carefully tighten the ALL-NU I.

E. In FLUSH-ALL 1 (this version only, diagram 1) the Flush rod is outside of the water tank. This version contains probably the only toilet tank/bowl system anywhere with the flush rod that is located outside of the water tank. This would protect the flush rod from the corrosive nature of water F. Rocker joint between the flush rod and the conical shaped washer (ALL-JOINT) see Flush-All 1 FIG. 2).

G. Rotating Joints, flow through, non-flow through, up and down (All-JOINTS).

H. Slip on Porcelain/Ceramic cover (ALL-COVER).

I. The preferred material for this device is stainless steel metal since the buyer would probably never need to replace it and an initial investment is worth it. Other material can be used to reduce consumer's cost or to ease production difficulty and appeal to those who can't afford the higher prices of the stainless steel version. Those other material can be a high impact plastics or some other heavy duty hardy polymers.

J. FLUSH-ALL 1 version has an option of a motion detected flushing. This one consists of a battery operated electromagnetic coil that exerts a repulsive (same magnetic polarity) on a pole that is positioned in its center. This would push this pole downward. This pole is mechanically connected by cross bracing to the flush rod. This momentary downward push of the pole caused by the battery activating the electromagnetic coil with a circuit board controlling the length of the activation (i.e. 5 seconds, 10 seconds etc.) a water is flushed down the toilet bowl at the end of the activation cycle the battery current to the coil is cut off and the flush rod spring load pushes back the pole back inside the coil as the final resting position.

This motion sensor is mounted on the side of the tank instead of facing forward this way no accidental flushing takes place while an individual is getting ready to use the toilet. A motion of the hands on the side of the tank will activate the flushing. This way the user has a total control on when to use automatic or manual flushing.

The flush system provides a continuous and controllable water volume and water flush rate that is not found in any toilet water flushing system. A gentle push on the flush handle will allow a partial and quiet flush that will clear a toilet bowl with light content and will not awaken sleeping people at night. Conventional toilet flusher gives you the choice of only a full on with no partial flushing choice.

This system can be retrofit into European style toilet systems, and in addition to the toilet bowl/tank, systems where the bowl and the tank are fused together into a single unit. FIG. 16 shows a perspective view of a European style toilet with an elevated tank. In this embodiment the ceramic porcelain slip on ALL-Cover 16 covers the elevated tank. The side of the ALL-Cover has a flush handle 30 above an optical sensor for touch-less flushing. A flush ring 36 and a flush chain 35 is connected to the flush handle 30. The tank is filled with the building 74 city water from a fill water line 73.

After the toilet is flushed fluid flows out of the elevated tank through a union joint 52 past a wall mount 53 mounted into the universal base mount and wall mount screw 54, down the flush water pipe 50 and into the toilet bowl 19.

Thus, specific embodiments of a toilet flush system have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. A toilet flush system comprising:
a sealed tank assembly;
said tank assembly having an input for a water supply;
said tank assembly having a trapped air and city water pressure reservoir;
said tank assembly having a water reservoir;
said pressure reservoir being pressurized by said water supply without an inlet valve;
a flushing mechanism that initializes a flush sequence;
said flushing mechanism is a handle or a motion activated sensor, and
said flushing mechanism raises and lowers a conical sealing washer.

2. The toilet flush system according to claim 1 wherein said pressure reservoir and said water reservoir are the same reservoir.

3. The toilet flush system according to claim 1 wherein said handle flushing mechanism operates through a ball and socket joint.

4. The toilet flush system according to claim 1 wherein said motion activated sensor is on a rotatable base.

5. The toilet flush system according to claim 1 wherein said sealed tank has a universal mounting base with more than two mounting holes.

6. The toilet flush system according to claim 5 further includes at least one threaded bolt and at least one nut.

7. The toilet flush system according to claim 1 wherein said conical washer is coated with rubber, silicone, nylon or metal.

8. The toilet flush system according to claim 1 wherein said conical washer seats in a conical recess.

9. The toilet flush system according to claim 8 further includes a spring to maintain said conical washer in said conical recess.

10. The toilet flush system according to claim 8 wherein said conical recess includes a plurality of flush water flow channels.

11. The toilet flush system according to claim 1 wherein said flush sequence is an instant on and off that is controlled by said flush mechanism.

12. The toilet flush system according to claim 1 wherein said flush sequence operates on demand.

13. The toilet flush system according to claim 1 wherein a user controls a flush volume.

14. The toilet flush system according to claim 3 wherein said motion activated sensor activates said flushing sequence based upon hand motion.

15. The toilet flush system according to claim 3 wherein said motion activated sensor operates a solenoid connected to a flush rod.

16. The toilet flush system according to claim 15 wherein a flush duration is adjustable.

17. The toilet flush system according to claim 1 wherein said toilet flush system is retrofitable on a pre-existing toilet bowl and further includes a porcelain slip-on cover.

18. The toilet flush system according to claim 8 wherein said conical recess includes at least one flush water flow channel.

19. The toilet flush system according to claim 1 further includes a spring that pre-loads a flush rod.

* * * * *